United States Patent [19]

Dacey, Jr.

[11] Patent Number: 4,993,295

[45] Date of Patent: Feb. 19, 1991

[54] PUNCH STRIPPER

[75] Inventor: Ernest A. Dacey, Jr., Highland, Mich.

[73] Assignee: Utica Enterprises, Inc., Sterling Heights, Mich.

[21] Appl. No.: 494,901

[22] Filed: Feb. 26, 1990

Related U.S. Application Data

[63] Continuation of Ser. No. 281,522, Dec. 8, 1988, abandoned.

[51] Int. Cl.[5] ..... B26D 7/06

[52] U.S. Cl. ..... 83/140; 83/143; 83/698

[58] Field of Search ..... 83/136, 137, 138, 140, 83/142, 143, 146, 698, 588

[56] References Cited

U.S. PATENT DOCUMENTS

| | | | |
|---|---|---|---|
| 1,723,935 | 8/1929 | Henricson | 83/140 |
| 2,168,377 | 8/1939 | Wales | 83/140 |
| 3,079,824 | 3/1963 | Schott | 83/698 |
| 3,114,280 | 12/1963 | Schott | 83/698 |
| 3,481,236 | 12/1969 | Nicklasson | 83/140 |
| 3,779,113 | 12/1973 | Jestin | 83/140 |
| 3,935,772 | 2/1976 | Demus et al. | 83/140 |
| 4,457,196 | 7/1984 | Cady . | |

*Primary Examiner*—Hien H. Phan
*Assistant Examiner*—Scott A. Smith
*Attorney, Agent, or Firm*—Remy J. VanOphem

[57] ABSTRACT

A punch stripper is formed with an axially aligned aperture extending therethrough so that the punch stripper can be installed on the shaft of a punch. The punch stripper includes a cylindrical housing with a plunger telescoped within an axially aligned bore. An array of spring elements are axially aligned within the cylindrical housing such that a biasing force is exerted on one end of the plunger. A cap is held in position by a snap ring at the end of the housing most remote from the plunger. The array of spring elements exert a biasing force on the cap. An elastomeric O-ring is positioned within the cap so that a frictional force can be developed between the punch stripper and a punch that passes therethrough.

11 Claims, 1 Drawing Sheet

PUNCH STRIPPER

This is a continuation of application Ser. No. 07/281,522, filed Dec. 8, 1988 now abandoned.

BACKGROUND OF THE INVENTION

1. Field of the Invention

The present invention relates to a punch press stripper assembly for use in any application where the withdrawal of the punch causes undesirable deformation of the material in the vicinity of the punch hole. More particularly, the invention involves a mechanical punch stripper that is assembled as a unit onto a punch or removed from a punch without the necessity of time consuming partial disassembly of the punch mechanism. The punch stripper assembly contains an encapsulated preloaded spring element capable of storing a maximum amount of energy with minimum displacement.

2. Description of the Prior Art

The prior art reveals a wide variety of devices for the punching of holes in sheet material and the prevention of sheet deformation surrounding the punched hole upon retraction of the punch from the sheet material. The integrity of the punched hole is preserved by the utilization of a stripper mechanism that is integrally coupled to the punch.

The present invention is an improvement over the punching unit shown and described in U.S. Pat. 3,779,113 entitled "Punching Unit" issued Dec. 18, 1973, to Paul Jestin. The above referenced patent shows a combination punch and stripper mechanism that is contained within a vertical bore. The vertical bore is located at the extremity of the upper cantilevered press arm. The vertical bore is coaxially disposed with a bore in the lower press arm for accommodation of a punch die. The punch and stripper mechanism contained in the upper bore can be removed therefrom by a stop detent. After the entire assembly has been removed from the upper press arm, the disengagement of the striker plate permits the punch to be removed from the remainder of the assembly.

In the above described punch and stripper assembly, the stripper subassembly cannot be replaced unless it is released from the press. Only after partial disassembly can the punch be removed.

While the above described punch and stripper assembly may suffice for a single punch application, the assembly removal does not lend itself to those applications where the punch ram utilizes a plurality of punches.

U.S. Pat. No. 3,283,630 entitled "Self-Cleaning Cutting Die with Stripper Element" issued Nov. 8, 1966, to Frank S. Domka shows a combination die and stripper. A single spring is used to bias the tubular stripper sleeve against the workpiece during and subsequent to the actual severing action of the punch. The compression spring is contained within a tubular body element. An adjustable screw threaded end cap coacts with the upper end of the tubular body element, providing a means to pre-load the compression spring. The stripper and the ejector are actuated by the compression spring which is enclosed within the die unit. The die unit itself is compact and may be removed from the platen of a press without disassembly.

U.S. Pat. No. 4,007,653 entitled "Punching Device with Punch Retainer" issued Feb. 15, 1977, to Percy L. Cady describes a punching device that includes a rigid frame for support of the punch assembly. The punch has a threaded upper end for coupling to a combination striker head and compression spring retainer. The compression spring is coaxial with the punch body and is biased against the upper flange of a tubular stripper which is also coaxial with the punch. A secondary spring is biased against the upper flange of the stripper to facilitate its removal from the surface of the workpiece subsequent to the severing of the punched material.

When the punch and stripper unit is removed from the press arm, the tubular stripper would slide off the punch except that a friction device has been positioned between the exterior surface of the cylindrical punch body and the interior surface of the stripper. The friction member is of elastomeric formulation and is positioned within a groove that has been machined in the punch body.

A punch stripper that is frictionally engageable with a punch is shown in U.S. Pat. No. 2,230,043 entitled "Punch Stripper" issued Apr. 22, 1940, to Harry M. Moran. This patent describes a punch stripper that is essentially a barrel shaped rubber spool. The stripper is retained on the punch shank by the friction developed between the cylindrical interior of the stripper and the exterior surface of the punch shank. Although the rubber stripper is removable by sliding it from the punch its application is limited to lighter metal punch applications since the resiliency characteristics are limited and, therefore, this type of stripper does not lend itself to heavy metal punching applications.

SUMMARY OF THE PRESENT INVENTION

The present invention is directed towards a mechanical punch stripper assembly that can be readily installed or removed from the cantilevered shaft of a punch. The mechanical punch stripper assembly includes a cylindrical housing that contains an axially extending aperture therethrough. A stripper plunger is arranged in telescoping arrangement within the aperture of the housing. Disengagement of the stripper plunger and the housing is effected by the coaction of a radially outwardly extending flange on the stripper plunger and a radially inwardly extending flange on the housing. An array of spring elements is positioned between the flanged head of the stripper plunger and a top plate or end cap that is affixed to the apertured housing end most remote from the stripper plunger. The end cap is held in fixed relationship to the housing by a snap ring. The end cap, spring elements and stripper plunger all contain an axially aligned bore for the reception of a punch. The end cap contains a groove that faces the punch bore. An elastomeric O-ring is positioned within the end cap groove such that it frictionally engages the exterior cylindrical surface of the punch.

Although each of the above set forth features may be found individually in the prior art, the prior art has not so far provided an inexpensive, simply mounted, readily replaceable, encapsulated pre-loaded spring assisted plunger mechanical stripper assembly. In most plunging situations it is desirable to prevent broken parts, such as springs, from contacting the workpiece or adjacent tools. Confinement of the spring elements within an enclosure not only prevents broken parts from escaping but, also, prevents dirt and other contaminants from contacting the spring elements, causing possible shortened life and potential parts failure. Additionally, mechanical punch stripper assemblies must be capable of delivering a strong load under a minimum of travel, thus a pre-loading capability of the spring elements is quite desirable.

Accordingly, it is a primary object of the present invention to provide a mechanical punch stripper assembly that will remain engaged with the punch shaft during its reciprocal operation yet can be removed from the punch by hand.

Another object of the invention is to provide a mechanical punch stripper assembly with discrete spring elements that can deliver a high load with a minimum of travel.

Yet another object of the invention is to provide a mechanical punch stripper which contains a pre-loaded spring element capable of storing a maximum amount of energy with minimum displacement.

A further object of the present invention is to permit replacement of individual spring elements without the necessity of replacing the entire spring.

Still another object of the present invention is to provide an enclosure for the spring elements to protect them from contaminants and damage from external forces.

Another object of the invention is to provide discrete spring elements in such numbers that a desirable pre-loading condition can exist within the mechanical punch stripper assembly.

A further object of the present invention is to provide a frictional element between the punch stripper and the punch that can be readily replaced with a minimum of time and effort expended.

Yet another object of the invention is to provide a mechanical punch stripper that contains a minimum number of parts and is relatively simple and inexpensive to manufacture.

Many other advantages and additional objects of the present invention will become apparent from the following detailed description thereof taken in conjunction with the accompanying drawings, in which the preferred structural embodiment incorporating the principles of the present invention is illustrated.

It is to be understood that the present invention is not limited in application to the details of construction and exact arrangement of parts illustrated in the above referenced drawings, since the invention is capable of other embodiments and of being practiced or carried out in various ways within the scope of the claims. Also, it is to be understood that the phraseology and terminology utilized herein is for the purpose of description and not of limitation.

DETAILED DESCRIPTION OF THE PREFERRED EMBODIMENT

Figure 1:
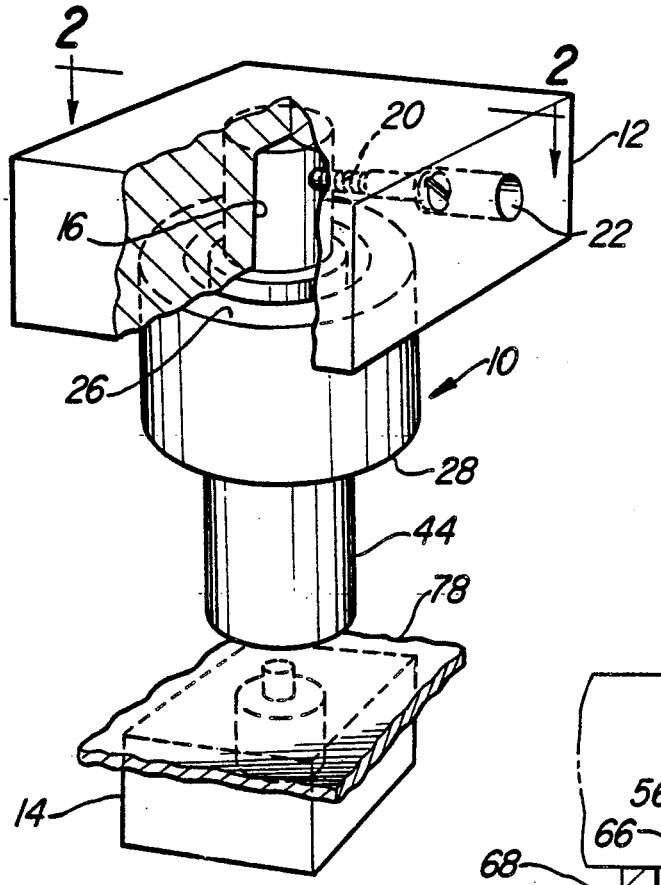
FIG. 1 is a perspective view, partly in section, which shows the present invention in a working environment.
Figure 2:
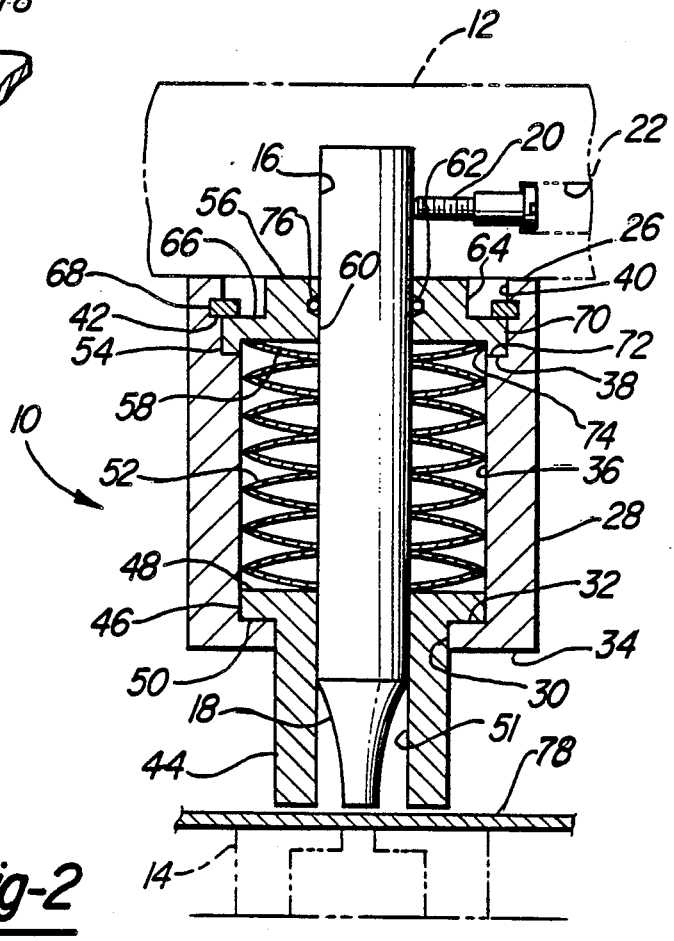
FIG. 2 is a sectional view taken along lines 2—2 of FIG. 1 that shows various parts of the present invention.

Referring now to FIGS. 1 and 2, there is illustrated a mechanical punch stripper that has application wherever punch operations are employed.

FIG. 1, which is a perspective view, partly in section, shows the environment in which the present invention is utilized. The mechanical punch stripper assembly 10 is shown interpositioned between a press ram 12 and a coacting press die button 14. The press ram 12 and the press die button 14 have a common axis which in many instances is vertically oriented.

The press ram 12 contains an axially aligned cylindrical bore 16 for the reception of a punch 18. The punch 18 is immobilized with respect to the press ram by any convenient punch retention means such as a threaded setscrew 20. The threaded set screw 20 is installed in a partially threaded bore 22. The bore 22 permits tool access from the exterior of the press ram 12 structure. In addition, the bore 22 is in communication with the cylindrical bore 16, permitting the threaded setscrew 20 to be biased against the exterior surface of the punch 18 thereby retaining the punch in the bore 16. The threaded setscrew 20 immobilizes the punch 18 so that it acts in unison with the press ram 12. The arrangement of the threaded screw 20 described above is but one of several methods of attaching a punch to the press ram.

The mechanical punch stripper assembly is installed by sliding it over the punch 18 so that its top surface 26 abuts against the bottom surface of the press ram 12. The mechanical punch stripper assembly 10 travels with the punch 18, thus there is actually no relative motion between the two parts as long as the punch is not functioning.

FIG. 2, which is a vertical view shown in section, along the plane indicated by lines 2—2 of FIG. 1, depicts the various elements of the mechanical punch stripper assembly 10 as well as the press ram 12 and the press die button 14.

The mechanical punch stripper assembly 10 includes a housing 28 that is of cylindrical configuration. The housing 28 has an axis of symmetry that is apertured throughout its extent. The aperture consists of a plurality of cylindrical surfaces of varying radii which will now be described. A small diameter plunger cavity 30 commences at the lower extent of the housing 28 as shown in FIG. 2. The plunger cavity 30 after a short axial extent, intersects a first radial planar area 32, defining a radially inwardly directed flange 34. The first radial planar area 32 intersects with a cylindrical spring cavity 36. The spring cavity 36 has a radius considerably larger than the plunger cavity 30. Also the spring cavity 36 extends over the greater axial extent of the housing 28. The spring cavity 36 terminates at its upper extent, as viewed in FIG. 2, by intersecting with a second radial planar area 38. The second radial planar area 38 intersects, at its most radial extent, with a cap cavity 40 that is also of cylindrical configuration. The cap cavity 40 has a radius that is greater than the spring cavity 36 described above. The cap cavity 40 intersects with the top surface 26 that is perpendicular to the overall vertical axis of the housing 28. Positioned intermediate the top surface 26 and the second radial planar area 38, is a snap ring groove 42 that penetrates the cylindrical wall of the cap cavity 40.

Attention will now be directed to those components of the invention that are contained partially or entirely within the previously described aperture of the housing 28. A plunger 44 is positioned within the plunger cavity 30 so that the greater extent of the cylindrically contoured external surface of the plunger 44 protrudes from the bottom of the housing 28 when the plunger 44 is in a non-loaded position. The plunger 44 has a radially outwardly extending flange 46. The flange 46 has planar surfaces 48 and 50 that are essentially parallel to one another, with the planar surface 50 abutting against the first radial planar area 32 of the housing 28 when the plunger 44 is in the non-loaded position. The plunger 44 has an axially aligned bore 51 that extends therethrough.

A plurality of spring elements 52 are installed within the spring cavity 36 of the housing 28. The spring elements 52 are of frustoconical configuration and are apertured at their centers. The spring elements 52 are manufactured by several manufacturers and are commonly called Belleville washers. The spring elements 52 are of particular value in those applications where it is imperative that a high thrust load be developed by a minimum deformation or flattening of the spring elements 52. Clearances between the apertures at the spring centers and the punch as well as between the ends of the spring elements 52 and the spring cavity 36 are proved to allow for deformation of the spring elements without interfering with the punch die or the bore of the spring cavity as the elements are deformed.

During installation of the spring elements 52, adjacent convex sides of the spring elements 52 are placed facing each other. In other words, the spring elements 52 assume an alternate position as they are installed within the spring cavity 36. As can be seen in FIG. 2 of the drawings, the lowermost spring element 52 rests against the planar surface 48 of the plunger flange 46. The spring element 52 is installed so that its edge adjacent the central aperture makes contact against the planar surface 48.

A cap 54 is utilized to contain and pre-load the spring elements 52 within the spring cavity 36. The cap 54 is of annular configuration with a top surface 56 and a bottom surface 58 that are parallel to one another and which are each essentially planar. The cap 54 contains an axially positioned cylindrical bore 60. Intermediate the top surface 56 and the bottom surface 58, a sealing ring or O-ring groove 62 is positioned in the wall of the cylindrical bore 60. The cap 54 has an external first cylindrical surface 64 that commences at the intersection of the top surface 56 and extends over a portion of the axial extent between the top surface 56 and the bottom surface 58. The first cylindrical surface 64 intersects a radially outwardly extending planar surface 66 that is essentially perpendicular to the central axis of the cylindrical bore 60. The planar surface 66 provides a bearing surface for a snap ring 68 which is positioned within the snap ring groove 42 of the housing 28. The cap 54 has an outermost second cylindrical surface 70 that intersects the greatest radial extent of the planar surface 66. The second cylindrical surface 70 extends in an axial direction beyond the bottom surface 58. The second cylindrical surface 70 intersects a radially inwardly extending planar surface 72. The planar surface 72, in turn, intersects a radially extending spring bore 74 that extends in an axial direction between the planar surface 72 and the bottom surface 58. The planar surface 72 contacts the second radial planar area 38 which is positioned in the housing 28.

The spring bore 74 permits the exterior peripheral edge of the spring element 52 to seat in the re-entrant corner formed by the intersection of the bottom surface 58 and the spring bore 74. By placing the peripheral edge of the spring element 52 in the above described corner, the possibility of the edge of the spring element 52 entering the juncture formed between the cap 54 and the housing 28 is minimized. The above described positioning of the spring elements 52 helps achieve a more symmetrical loading condition of the snap ring 68.

In order to provide a friction means between the mechanical punch stripper assembly 10 and the punch 18, an appropriately sized elastomeric O-ring 76 is positioned within the O-ring groove 62.

OPERATION AND ASSEMBLY

During the assembly of the punch stripper assembly 10, the housing 28 is positioned in an upright position, that is, with the snap ring groove 42 toward the top. The leading edge of the plunger 44 is then dropped through the plunger cavity 30 until the flange 46 engages the first radial planar area 32 of the housing 28. A spring element 52 is then positioned adjacent to the flange 46 with the concave side of the spring element facing in an upward direction. Additional spring elements 52 are installed so that their respective peripheral edges are in contact with each other. The last spring element 52 is positioned so that its outermost peripheral edge is in the re-entrant corner formed by the bottom surface 58 and the spring bore 74 of the cap 54. The stacked array of spring elements 52 causes the cap 54 to ride high on the second cylindrical surface 70 of the housing 28. As the cap 54 is pushed into position for the installation of the snap ring 68, the array of spring elements 52 is placed in a state of compression or preloading. The O-ring 76 can be placed within the O-ring groove 62 at final assembly, or the O-ring 76 can be installed prior to installation of the cap 54 on the array of spring elements 52. By way of example, the pre-loading for one size of the present invention was in the range of 50–60 pounds of force. After the array of spring elements 52 had been compressed twenty-three percent (23%) of the spring cavity 36 distance, the compressive load was in the range of 400–425 pounds of force.

The mechanical punch stripper assembly 10 is utilized by sliding it by hand over the shaft of a punch 18 as depicted in the drawings. The axially aligned cylindrical bore 60 of the cap 54 and the bore 51 of the plunger 44 are slightly larger in diameter than the diameter of the punch 18. Consequently, the punch 18 can move through the cylindrical bore 60 and the bore 51 with little effort. The net inside diameter of the O-ring 76 torus is slightly smaller than the diameter of the punch 18, therefore, sufficient frictional force is developed to hold the mechanical punch stripper assembly 10 in an immobilized position with respect to the punch 18 and the press ram 12 during the operation phase of the press. Should the punch stripper assembly 10 drift downward slightly during any given operational cycle, it is returned to its desired position as the punch 18 is lowered sufficiently to cause an upward force to be generated by the plunger 44 as it contacts a workpiece 78.

As the press ram 12 begins to move towards the press die button 14, the plunger 44 contacts the workpiece 78 before the punch touches the workpiece. As downward travel continues, the plunger is stopped by the workpiece and lifts from the first radial planar area 32 to compress the plurality of spring elements and thereby place a holding force on the workpiece. The punch then continues to move down with the housing 28 and enters the workpiece to punch out the desired form. As the punch reaches the end of its stroke and begins its return stroke, the plunger 44 maintains the workpiece in position with the force generated by the spring elements 52 until the punch completely retracts from the workpiece 78. Since the pre-load was established in the plurality of spring elements 52 the punch will continue to travel upward and the pre-load continues to hold the plunger until such time that the first radial planar area 32 of the housing contacts the plunger and moves the plunger upward to thereby relieve the workpiece. The frictional relationship established between the punch and the O-ring is such that the punch will continue to carry the housing and plunger until the press ram is back in its original starting position.

The present invention provides a new and novel mechanical punch stripper that minimizes operational displacement and provides a compact design that can be removed from a punch without the aid of tools.

It should be understood that the invention is not limited to the exact details of the foregoing embodiment, and that changes and modifications can be readily made by one skilled in the art without departing from the scope of the claims appended hereto.

What is claimed is:

1. A punch stripper assembly which can be removably mounted to a punch rigidly mounted to a press ram, said punch stripper assembly comprising:

a housing having a generally cylindrical exterior configuration, said housing having an aperture extending therethrough, one end of said housing abutting against said press ram when said punch stripper assembly is mounted to said punch;

a plunger disposed within a portion of said aperture in telescoping arrangement therewith, said plunger having a flange that coacts with a flange formed as an integral part of said housing at an end of said housing opposite said one end, said plunger containing an axially aligned bore sized to receive said punch therethrough;

a cap disposed in said aperture of said housing at said one end adapted to receive said punch therethrough, said cap having a centrally positioned cylindrical bore;

a snap ring securing said cap within said aperture;

a circumferentially extending groove provided in a wall of said cylindrical bore;

friction means disposed in said groove for frictionally retaining said cap to said punch, said friction means protruding outwardly from said wall to frictionally engage said punch;

an array of spring elements disposed in said aperture between said cap and said flange of said plunger, said array of spring elements biasing said flange of said plunger against said flange formed as an integral part of said housing and said cap against said snap ring when said array of spring elements are in a state of compression; and whereby said punch stripper assembly is removably mounted to said punch and said press ram by sequentially inserting said punch through said centrally positioned cylindrical bore of said cap, through said friction means, and through said axially aligned bore of said plunger, said punch stripper assembly being retained on said punch by said friction means, said punch stripper assembly thereby being removable as a discrete unit from said punch and press ram without requiring simultaneous removal of said punch or disassembly of said punch stripper assembly.

2. A punch stripper assembly which can be removably mounted to a punch rigidly mounted to a press ram, said punch stripper assembly comprising:

a housing of generally cylindrical exterior configuration, said housing having an aperture extending therethrough, said aperture comprising a plunger cavity at one end thereof, a spring cavity having a larger diameter than said plunger cavity and a cap cavity at the opposite end of said housing having a larger diameter than said spring cavity, said housing having an axis of symmetry common to said cavities, said opposite end of said housing abutting against said press ram when said punch stripper assembly is mounted to said punch;

a plunger disposed within said plunger cavity and extending into said spring cavity, said plunger being positioned in telescoping arrangement with said housing, said plunger having a cylindrical exterior surface with a radially outwardly extending flange provided at the end extending into said spring cavity, said flange coacting with a radially inward flange formed at the interface of said plunger cavity and said spring cavity, said plunger having a centrally positioned bore that has a longitudinal axis that is common to said axis of symmetry of said housing;

a cap disposed in said cap cavity, said cap being fixed in said cap cavity between a snap ring that extends radially into a snap ring groove contained in the wall of said cap cavity of said housing and a planar surface formed at the interface of said spring cavity and said cap cavity, said cap having a centrally positioned cylindrical bore that has a longitudinal axis concentric with said axis of symmetry of said housing, said cap additionally having a top surface and a bottom surface, said bottom surface being arranged perpendicular to said longitudinal axis of said cylindrical bore;

a circumferentially extending groove provided in the wall of said cylindrical bore;

friction means positioned within said groove for frictionally securing said cap to said punch, said friction means having the configuration of a torus, the inside diameter of said torus having a dimension less than the diameter of said bore of said punch;

a plurality of spring elements, each of said plurality of spring elements being of generally frustoconical configuration with a centrally positioned aperture therethrough that is greater in diameter than the diameter of said punch, said plurality of spring elements being compressively disposed within said spring cavity, said plurality of spring elements biasing said flange of said plunger against said flange formed at said interface between said plunger cavity and said spring cavity and biasing said cap against said snap ring when said plurality of spring elements are in a state of compression; and whereby said punch stripper assembly is removably mounted to said punch and said press ram by sequentially inserting said punch through said centrally positioned cylindrical bore of said cap, through said friction means, and through said centrally positioned bore of said plunger, said punch stripper assembly being retained on said punch by said friction means, said punch stripper assembly thereby being removable as a discrete unit from said press ram and said punch without requiring simultaneous removal of said punch or disassembly of said punch stripper assembly.

3. A punch stripper assembly which can be removably mounted to a punch rigidly mounted to a press ram, said punch stripper assembly comprising:

a housing having a cylindrical exterior, said housing having an aperture extending through said housing concentric with said cylindrical exterior, said aperture comprising a plunger cavity provided at one end of said housing, an intermediate spring cavity and a cap cavity provided at the other end of said housing, said plunger cavity having a diameter selected to provide a radially inward flange at said one end of said housing, said housing having an axis of symmetry concentric with said cylindrical exterior and a planar top surface provided at said other end which is perpendicular to said axis of symmetry, said planar top surface abutting against said press ram when said punch stripper assembly is mounted to said punch;

a plunger disposed within said plunger cavity and extending into said spring cavity, said plunger being disposed in telescoping arrangement with said housing, said plunger having a cylindrical exterior surface and a radially outwardly extending flange at said end extending into said spring cavity, said flange coacting with said radially inward flange of said housing, said plunger having a bore concentric with said axis of symmetry and an end opposite said flange that is perpendicular to said axis of symmetry;

a cap disposed in said cap cavity of said housing, said cap being fixed in said cap cavity by a snap ring that extends radially into a snap ring groove provided in the wall of said cap cavity of said housing, said cap having a cylindrical bore concentric with said axis of symmetry, a top surface and a bottom surface generally parallel to said top surface, said bottom surface being disposed perpendicular to said axis of symmetry, said cap further having a first cylindrical surface which intersects said top surface and a second cylindrical surface, said first cylindrical surface having a radius less than the radius of said second cylindrical surface;

a circumferentially extending groove positioned in the wall of said cylindrical bore between said top and bottom surfaces;

an O-ring disposed within said groove, said O-ring having the configuration of a torus, the inside diameter of said torus having a dimension less than the diameter of said punch;

a plurality of spring elements, each of said plurality of spring elements being of generally frustonconical configuration with a centrally positioned aperture therethrough that has a diameter greater than the diameter of said punch, said plurality of spring elements being disposed within said spring cavity of said housing, said plurality of spring elements biasing said flange of said plunger against said radially inward flange of said housing and said cap against said snap ring when said plurality of spring elements are in a state of compression; and whereby said punch stripper assembly is removably mounted to said punch and said press ram by sequentially inserting said punch through said cylindrical bore provided in said cap, through said O-ring, and through said bore provided through said plunger, said punch stripper assembly being retained on said punch by said O-ring, said punch stripper assembly thereby being removable as a discrete unit from said press ram and said punch without requiring simultaneous removal of said punch or disassembly of said punch stripper assembly.

4. The punch stripper assembly of claim 3 wherein each said spring element of said plurality of spring elements have an inside edge defining said centrally positioned aperture and an outside edge defining the greatest radial extent of each said spring element, each said spring element being positioned within said spring cavity so that a concave side of each said spring element faces a corresponding concave side of an adjacent spring element.

5. The punch stripper assembly of claim 3 wherein said spring element adjacent said cap is positioned so that said concave side faces said cap.

6. The punch stripper assembly of claim 3 wherein the difference between the radii of said first and second cylindrical surfaces is large enough for the installation and removal of said snap ring in said snap ring groove.

7. The punch stripper assembly of claim 3 wherein said top surface of said cap and said top surface of said housing are coplanar.

8. The punch stripper assembly of claim 3 wherein said plurality of spring elements is pre-loaded during the assembly thereof.

9. The punch stripper assembly of claim 3 wherein said plurality of spring elements is pre-loaded in the range from 50 to 60 pounds and delivers a force in the range of 400 to 425 pounds when said plurality of spring elements is compressed twenty-three percent (23%) of said spring cavity extent.

10. The punch stripper assembly of claim 3 wherein the compression of said O-ring against a punch installed through said punch stripper assembly develops a friction selected to counterbalance the weight of said punch stripper assembly and acceleration forces associated therewith.

11. The punch stripper assembly of claim 3 wherein said cap has a planar surface at the interface of said first and second cylindrical surfaces, said snap ring bears against said planar surface.

* * * * *

UNITED STATES PATENT AND TRADEMARK OFFICE

CERTIFICATE OF CORRECTION

PATENT NO. : 4,993,295

DATED : February 19, 1991

INVENTOR(S) : Ernest A. Dacey, Jr.

It is certified that error appears in the above-identified patent and that said Letters Patent is hereby corrected as shown below:

Column 5, line 16, delete "proved" and insert ---- provided ----.

Column 8, line 39, delete "said bore of".

Column 9, line 48, delete "frustonconical" and insert ---- frustoconical ----.

Signed and Sealed this

Eighth Day of September, 1992

*Attest:*

DOUGLAS B. COMER

*Attesting Officer*

*Acting Commissioner of Patents and Trademarks*